US007522113B2

(12) United States Patent
Andrenko et al.

(10) Patent No.: US 7,522,113 B2
(45) Date of Patent: Apr. 21, 2009

(54) PLANAR ANTENNA

(75) Inventors: Andrey Andrenko, Kawasaki (JP); Toru Maniwa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 472 days.

(21) Appl. No.: 11/287,234

(22) Filed: Nov. 28, 2005

(65) Prior Publication Data

US 2007/0046542 A1 Mar. 1, 2007

(30) Foreign Application Priority Data

Aug. 29, 2005 (JP) ..... 2005-247963

(51) Int. Cl.
*H01Q 21/00* (2006.01)

(52) U.S. Cl. ..... 343/726; 343/795; 343/818

(58) Field of Classification Search ..... 343/725, 343/726, 728, 833, 834, 837, 700 MS, 795, 343/818

See application file for complete search history.

(56) References Cited

U.S. PATENT DOCUMENTS

| | | | | |
|---|---|---|---|---|
| 4,809,009 | A * | 2/1989 | Grimes et al. | 343/726 |
| 5,572,226 | A * | 11/1996 | Tuttle | 343/726 |
| 6,057,803 | A | 5/2000 | Kane et al. | |
| 6,320,544 | B1 * | 11/2001 | Korisch et al. | 343/700 MS |
| 6,646,615 | B2 * | 11/2003 | Andrews et al. | 343/726 |
| 7,265,720 | B1 * | 9/2007 | Ponce De Leon et al. | 343/700 MS |
| 2004/0100413 | A1 | 5/2004 | Waldner | |

FOREIGN PATENT DOCUMENTS

| | | |
|---|---|---|
| DE | 195 28 703 A1 | 3/1996 |
| GB | 2 111 756 A | 7/1983 |
| GB | 2 293 050 A | 3/1996 |
| JP | 07-249921 A | 9/1995 |
| JP | HEI9-260926 | 10/1997 |
| JP | 2005-072716 | 3/2005 |
| JP | 2005-102183 | 4/2005 |
| JP | 2005-167619 | 6/2005 |

OTHER PUBLICATIONS

Y. Ojiro, et al., "A Monopole-Fed Circularly Polarized Loop Antenna," Antennas and Propagation Society International Symposium, 1998, Atlanta, GA, *IEEE*, vol. 2, Jun. 21, 1993, pp. 810-813.

* cited by examiner

*Primary Examiner*—Tan Ho
(74) *Attorney, Agent, or Firm*—Hanify & King, PC

(57) ABSTRACT

The present planar antenna include: a linear antenna element to which electric power is to be supplied and a loop-shaped parasitic antenna element placed in the vicinity of said linear antenna element, which are provided on one side of a dielectric substrate. This simple arrangement makes it possible to provide a planar antenna with good circular polarization characteristics.

7 Claims, 11 Drawing Sheets

PLANAR ANTENNA

CROSS REFERENCE TO RELATED APPLICATIONS

This application is based on and hereby claims priority to Japanese Application No. 2005-247963 filed on Aug. 29, 2005 in Japan, the contents of which are hereby incorporated by reference.

BACKGROUND OF THE INVENTION (1) Field of the Invention

The present invention relates to a planar antenna. The invention relates particularly to an art suitable for use as an antenna which is formed on a dielectric substrate to generate circularly polarized waves.

(2) Description of the Related Art

Recently, vehicles (movable objects) such as automobiles are often equipped with antennas for high-frequency band GPS (Global Positioning System) and antennas for receiving satellite radio waves of satellite digital broadcasting. In addition, there is a need for antennas for transceiving radio waves in ETC (Electronic Toll Collection) system, which automatically collects tolls for express ways and toll roads, and radio beacons in VICS (Vehicle Information Communications System), which provides traffic information.

Of such radio waves to be transceived by movable objects, circularly polarized waves are used in GPS radio waves, satellite radio waves for satellite broadcasting, and ETC radio waves. Most of the previous antennas for circularly polarized waves are patch antennas (planar antenna).

FIG. 11 is a schematic plan view showing a construction of an example of a previous planar antenna, and it is disclosed in the following patent document 1. The planar antenna of FIG. 11, which is for receiving right-hand circularly polarized waves, includes a square-like loop antenna (power-fed element) 120 and a linear electric conductor [parasitic (non-power-supplied) element] 140 mounted on a dielectric (transparent film). The linear electric conductor 140, which is an independent conductor not coupled to the loop antenna 120, is bent to be divided into two parts, a first part 140A and a second part 140B. Reference characters 160 and 170 designate power-feeding terminals for supplying the loop antenna 120 with electric power; reference character 270 designates connecting conductors which connect power-feeding terminals 160 and 170 to the loop antenna 120; reference character CP designates the center point of the loop antenna 120.

As shown in FIG. 11, the parasitic element 140 is placed outside the loop antenna 120 and is arranged close to the loop antenna 120. In more detail, the first part 140A is placed in parallel with one side of the loop antenna 120; the second part 140B is placed in parallel with a straight line which connects an intermediate point between the power-feeding terminals 160 and 170 and an apex of the loop antenna 120 which is opposite the intermediate point.

Referring to paragraph [0069] of the following patent document 1, a description will be made hereinbelow of the parasitic element 140. A loop antenna 120 without a parasitic element 140, in particular, a loop antenna 120 whose circumference (the total length of the antenna conductor) is equal to one wavelength, can receive only an electric field component (lateral component) in the horizontal direction (that is, it is impossible to completely receive circularly polarized waves in which the direction of the electric field changes over time). The parasitic element 140 arranged close to the loop antenna 120 makes it possible for the loop antenna 120 to receive a vertical component of the circularly polarized waves.

That is, the second part 140B of the parasitic element 140 takes in the vertical component of the circularly polarized waves, and this received vertical component is coupled to the antenna conductor of the loop antenna 120 by the first part 140A which is close to the antenna conductor of the loop antenna 120. As a result, the vertical and lateral components of the circularly polarized waves are received by the loop antenna 120 in phase. In other words, with only the second part 140B, it is difficult to transfer the received circularly polarized waves to the loop antenna 120. Thus, in order to efficiently transfer the received circularly polarized waves to the loop antenna 120, the parasitic element 140 is provided with the first part 140A.

Further, other previous antenna construction are disclosed in the following patent documents 2 and 3.

Patent document 2 relates to a thin and flat antenna construction including more than one stacked loop antenna element. The antenna of patent document 2 is capable of generating left-hand circularly polarized waves and right-hand circularly polarized waves at the same time from two directions.

Patent document 3 relates to an antenna construction in which a large square row antenna is provided in the plane of an antenna. Inside the large antenna, a small dipole antenna, a loop antenna, and a planar antenna are arranged so that the directivities of the antennas formed by interference of the antennas are optimum.

[Patent document 1] Japanese Patent Application Laid-open No. 2005-102183

[Patent document 2] Japanese Patent Application Laid-open No. 2005-72716

[Patent document 3] Japanese Patent Application Laid-open No. HEI 9-260925

However, the art disclosed in patent document 1 is disadvantageous in that electric field distribution to the parasitic element 140 is weak due to the antenna construction, so that it is difficult to obtain a sufficiently good circular polarization characteristic. This is probably because a linear antenna (e.g., a dipole antenna) simply mounted on a dielectric substrate generates a beam in the direction along the surface of the dielectric substrate, so that the intensity of radiation in the direction (that is, the direction along the thickness) crossing the surface of the dielectric substrate is weak.

Here, the purpose of the art of patent document 2 is generating left-hand and right-hand circularly polarized waves at the same time. In patent document 3, it is possible to place multiple antennas closely or concentratedly in a narrow area, and thus down-sizing is available, and the purpose of the invention is to prevent noise from inside automobiles. Therefore, neither of the applications aims at obtaining a good circular polarization characteristic.

SUMMARY OF THE INVENTION

With the foregoing problems in view, it is an object of the present invention to provide a planar antenna with simple configuration which realizes a good circular polarization characteristic. Here, the application of the present invention should by no means be limited to movable objects such as automobiles, and the present invention is applicable also to POS systems and security systems for preventing product theft.

In order to accomplish the above object, according to the present invention, there is a planar antenna provided with the following characteristic features.

(1) As a generic feature, the planar antenna comprises: on one side of a dielectric substrate, a linear antenna element to which electric power is to be supplied; and a loop-shaped parasitic antenna element placed in the vicinity of the linear antenna element.

(2) As a preferred feature, the loop-shaped parasitic antenna element is placed so as to produce cross polarized waves which crosses polarized waves produced by the linear antenna element.

(3) As another preferred feature, the loop-shaped parasitic antenna element has a linear portion extending in a direction which crosses the linear antenna element, to produce the cross polarized waves.

(4) As yet another preferred feature, two of the loop-shaped parasitic antenna elements are placed symmetrically with respect to a center point of the linear antenna element.

(5) As a further preferred feature, the two loop-shaped parasitic antenna elements are provided in the vicinity of the opposite ends of the linear antenna element.

(6) As a still further preferred feature, each of the loop-shaped parasitic antenna elements has a rectangular shape in the plane of the dielectric substrate, the rectangular shape having a long side which is the linear portion extending in a direction which crosses the linear antenna element.

(7) As another preferred feature, the linear antenna element is a dipole antenna.

(8) As another generic feature, the planar antenna comprises: on one side of a dielectric substrate, a power-fed loop-shaped antenna element to which electric power is to be supplied; and a loop-shaped parasitic antenna element placed in the vicinity of the power-fed loop-shaped antenna element.

(9) As a preferred feature, the power-fed loop-shaped antenna element has a rectangular shape, and two of the loop-shaped parasitic antenna elements are placed, in the vicinity of opposite short sides of the power-fed loop-shaped antenna element, symmetrically with respect to the center point of the power-fed loop-shaped antenna element.

(10) As another preferred feature, the power-fed loop-shaped antenna element is a folded dipole antenna, and two of the loop-shaped parasitic antenna elements are placed, in the vicinity of the opposite long sides of the folded dipole antenna, symmetrically with respect to the center point of the folded dipole antenna.

According to the planar antenna of the present invention, simple antenna patterns (a power-fed linear antenna element or a power-fed loop-shaped antenna element and a parasitic loop-shaped antenna element) formed on one surface of the dielectric substrate are capable of producing circularly polarized waves with good characteristics on the opposite sides of the dielectric substrate. Accordingly, it is possible for the planar antenna of the present invention to efficiently receive circularly polarized waves in which the direction of the electric field changes over time, such as radio waves for GPS, satellite radio waves for satellite digital broadcasting, and radio waves for ETC, so that the reception characteristic of the circularly polarized waves is improved.

Other objects and further features of the present invention will be apparent from the following detailed description when read in conjunction with the accompanying drawings.

DESCRIPTION OF THE PREFERRED EMBODIMENT(S)

(1) First Embodiment

Figure 1:
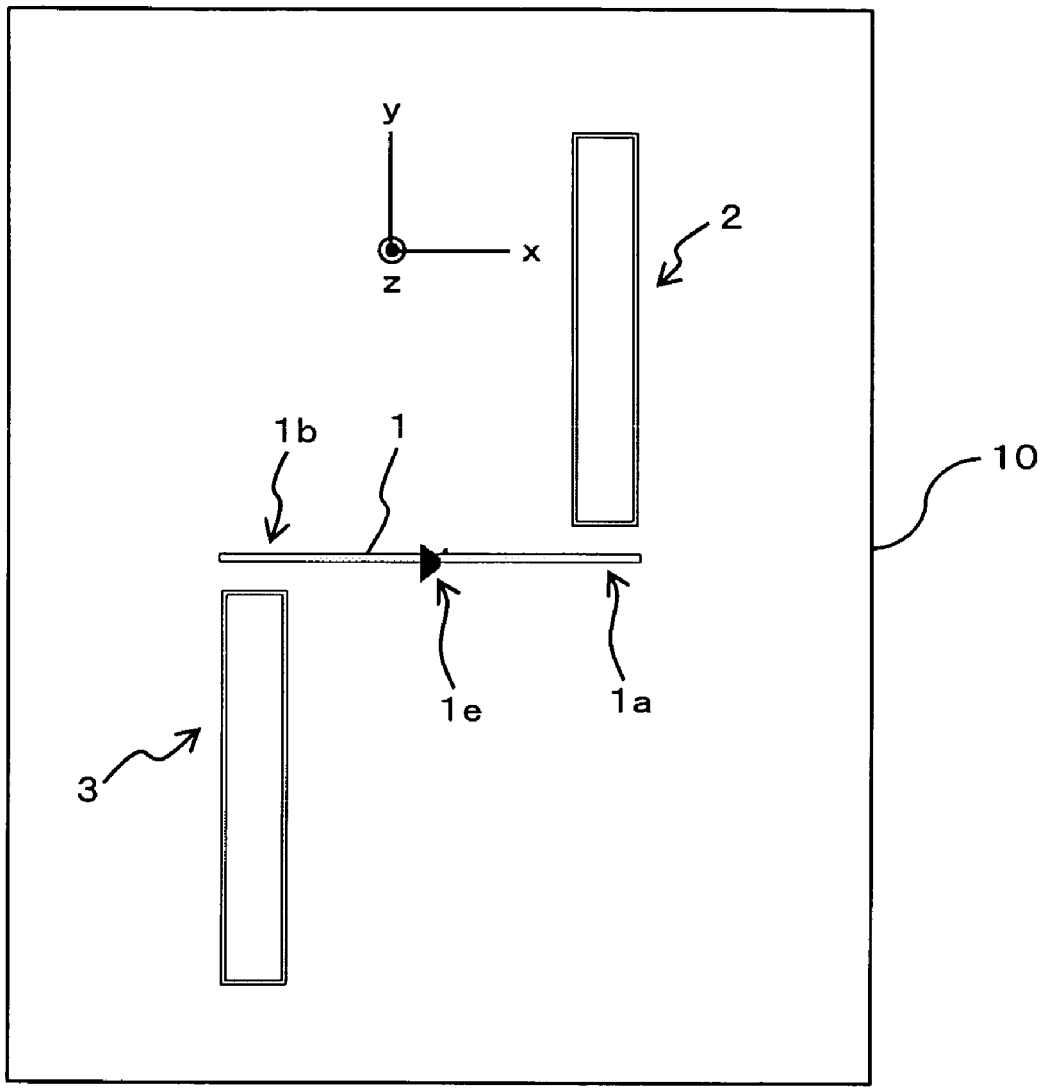
FIG. 1 is a schematic plan view showing a construction of a planar antenna according to a first embodiment of the present invention.

FIG. 1 is a schematic plan view showing a construction of a planar antenna according to a first embodiment of the present invention. In the planar antenna of FIG. 1, a dipole antenna element (linear antenna element) 1, which is a linear antenna conductor supplied with electric power (power-fed) from a feeding point 1*e*, is formed on one side of a dielectric substrate (hereinafter will be simply called the "dielectric" or "substrate") 10, which is made of, for example, glass or ceramic. The substrate can be divided into two areas (divisional areas) with the dipole antenna element 1 as a boundary. In one of the two divisions (the part above the dipole antenna element 1 of FIG. 1) a first loop antenna element (a parasitic loop-shaped antenna element serving as an electromagnetic coupling loop) which is not supplied with electric power and is loop-shaped (rectangular shape) 2 is formed in the vicinity of one end 1*a* of the dipole antenna element 1. The first loop antenna element 2 is placed in such a manner that one of its short sides is positioned in the proximity of one end 1*a* of the dipole antenna element 1, and that its long sides extend in the direction (+y-axis direction) which crosses the dipole antenna element 1 in the substrate plane (x-y plane). In the other divisional area (the side lower than the dipole antenna element 1 of FIG. 1), a second loop antenna element (a parasitic loop-shaped antenna element serving as an electromagnetic coupling loop) 3 which is not supplied with electric power and is loop-shaped (rectangular shape) 2 is formed in the vicinity of the other end 1*b* of the dipole antenna element 1. The second loop antenna element 3 is placed in such a manner that one of its short sides is positioned in the proximity of the other end 1*b* of the dipole antenna element 1, and that its long sides extend in the direction (−y-axis direction) which crosses the dipole antenna element 1 in the substrate plane.

Figure 2:
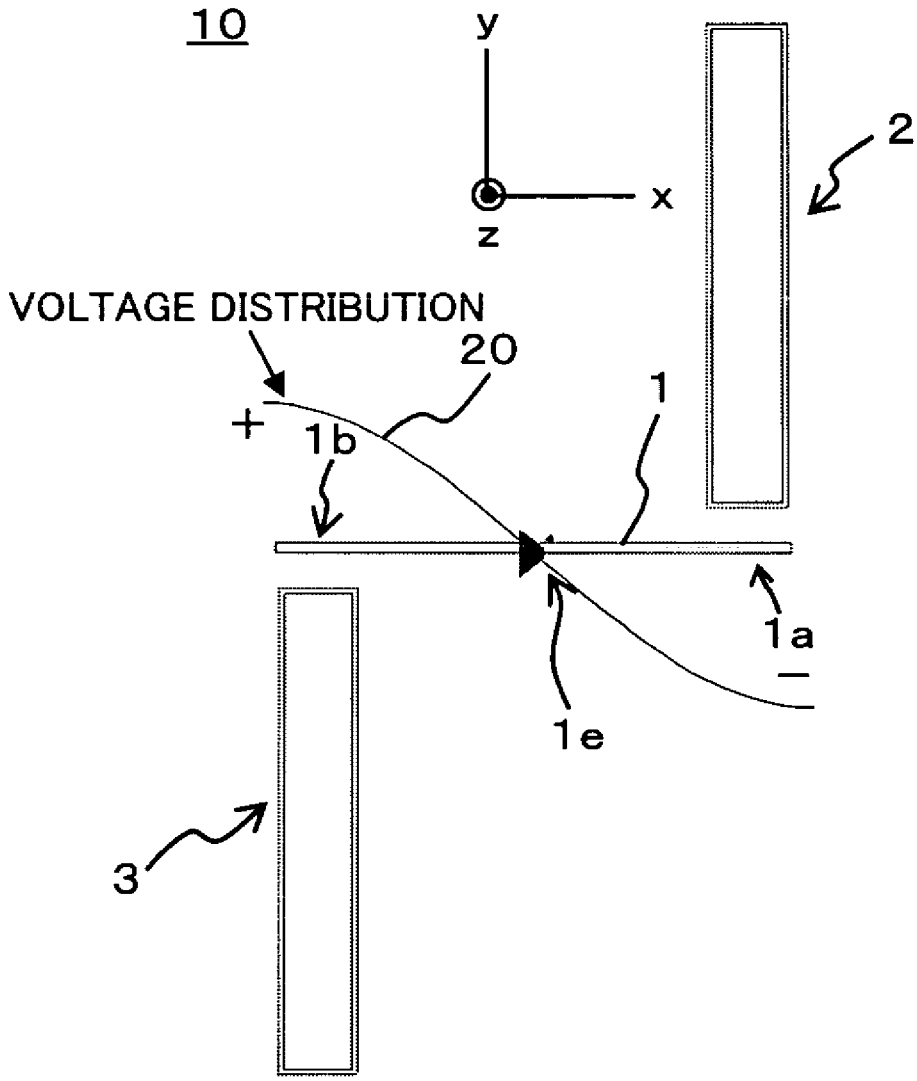
FIG. 2 is a schematic plan view showing the distribution of voltage when power is supplied to the planar antenna of FIG. 1, together with an antenna construction.

In other words, the loop antenna elements 2 and 3 are formed/placed in the vicinity of the dipole antenna element 1, symmetrically with respect to the center point of the dipole antenna element 1, so that the loop antenna elements 2 and 3 can be electromagnetically coupled to the dipole antenna element 1. Here, the reason why the loop antenna elements 2 and 3 are placed in the vicinity of the opposite ends 1*a* and 1*b* of the dipole antenna element 1 is that in the distribution of voltage of a dipole antenna element 1, the voltage value (absolute value) becomes greater at positions closer to the opposite ends 1*a* and 1*b*, away from the center (in the proximity of the feeding point 1*e*) of the dipole antenna element 1 (the value takes the maximum value at opposite ends 1*a* and 1*b*), as shown in FIG. 2 with reference character 20, resulting in good coupling efficiency. Further, it is possible to easily form the antenna elements 1, 2, and 3 (conductive patterns) using printing technology such as silver printing (the same goes for the following embodiments).

If electric power is supplied to the dipole antenna element 1 under such an antenna construction, an electric field is radiated in the z-axis direction (the vertical direction relative to the paper sheet of FIG. 1) so that the dipole antenna element 1 has a first cross polarization component, and each of the loop antenna elements 2 and 3 has a second cross polarization component whose phase is delayed by 90° in comparison with the first cross polarization component and polarization is also different from that of the first cross polarization component by 90°.

In more detail, the dipole antenna element 1 generates an electric field ($E_x$ field) having a polarization component (horizontal polarization) in the x-axis direction, and the electric field is coupled to each of the loop antenna elements 2 and 3, whereby electric current flows in the loop antenna elements 2 and 3. In this instance, since the long sides of the loop antenna elements 2 and 3 extend in the y-axis direction, an electric field ($E_y$ field) has a strong polarization component (vertical polarization) in the y-axis direction in comparison with in the x-axis direction.

As a result, in the z-axis direction, an electric field resultant from composition of the above $E_x$ field and $E_y$ field, that is, circular polarization [in this case, right-hand circularly polarized (RHCP) waves] are generated. In other words, in the above planner antenna, the loop antenna elements 2 and 3, serving as a parasitic loop-shaped antenna element, are arranged so as to produce cross polarized waves (vertically polarized waves) which cross polarized waves (horizontally polarized waves) generated by the dipole antenna element 1. Further, each of the loop antenna elements 2 and 3 has a rectangular shape having linear portions (long sides) thereof extending in the direction which crosses the dipole antenna element 1, so as to produce the vertical polarization.

Here, it is possible to adjust the intensity and the phase of the cross electric fields which are orthogonal to each other by means of adjusting (i) the shape of the loop antenna elements 2 and 3 (the shape of the portion at which the loop antenna elements 2 and 3 are coupled to the dipole antenna element 1), (ii) the distance in the y-axis direction between the dipole antenna element 1 and the loop antenna elements 2 and 3, and (iii) the positions of the loop antenna elements 2 and 3 in the x-axis direction. As a result, it is possible to obtain almost ideal circularly polarized waves.

For example, the following simulation parameters are given: the size of the dielectric substrate 10 is 300 mm (vertical length)×300 mm (lateral length)×6 mm (thickness); the dielectric constant $\in_r$ is 7; the conductivity of the dipole antenna element 1 and of the loop antenna elements 2 and 3 is $5\times10^6$, the length of the dipole antenna element 1 is a half-wavelength ($\lambda/2$) of the wavelength $\lambda$ of a radio signal to be transceived (for example, 97.4 mm); the lengths of the long and the short sides of each of the loop antenna elements 2 and 3 are 95 mm and 15 mm, respectively (95 mm×15 mm), so that the total loop length is 220 mm; each of the loop antenna elements 2 and 3 are placed at a position approximately 7 mm away from the dipole antenna element 1 in the y-axis direction, and approximately 33 mm away from the center point of the dipole antenna element 1. With this construction, if power is supplied to the dipole antenna element 1 by a 953 MHz radio signal, circular polarization characteristics shown in FIG. 3 through FIG. 6 are obtained as simulation results.

Figure 3:
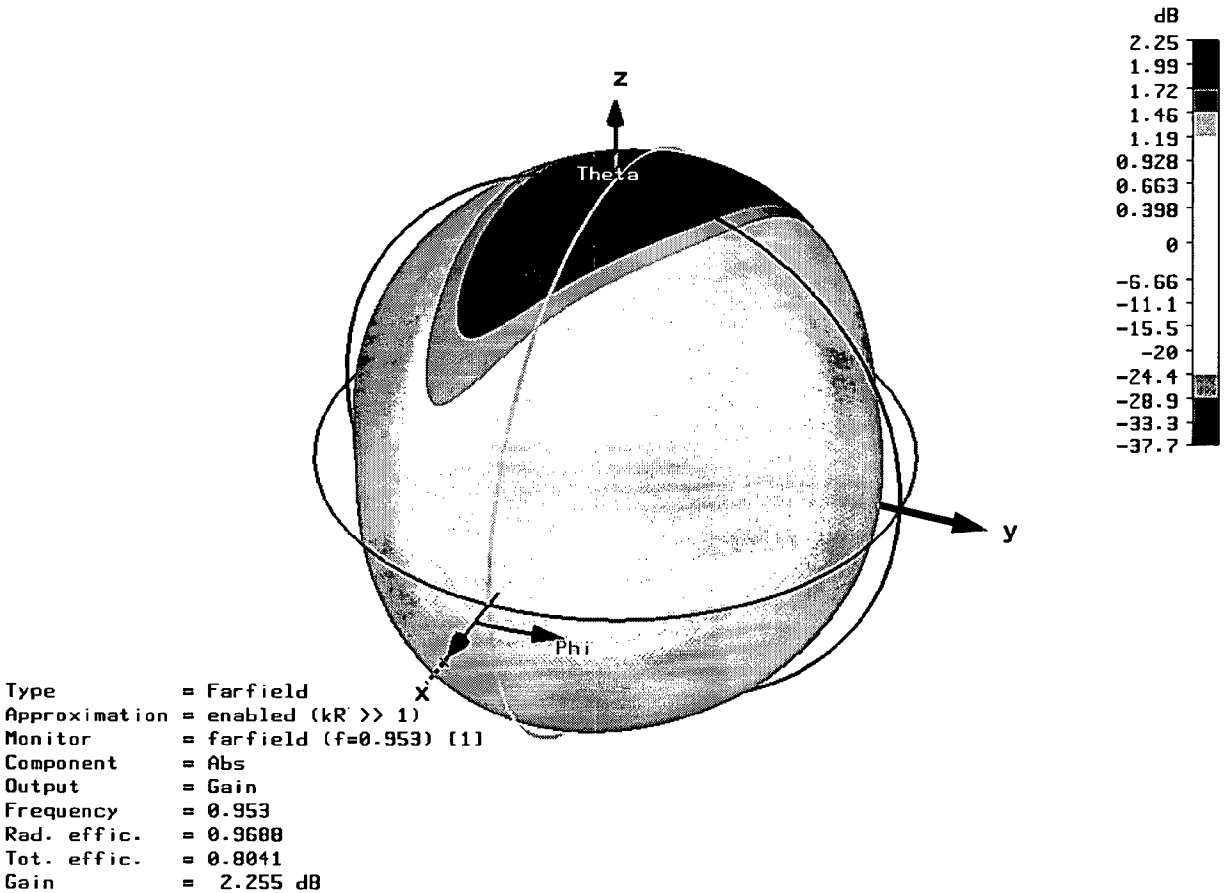
FIG. 3 is a diagram illustrating an example of a three-dimensional power gain radiation pattern of the planar antenna of FIG. 1.
Figure 4:
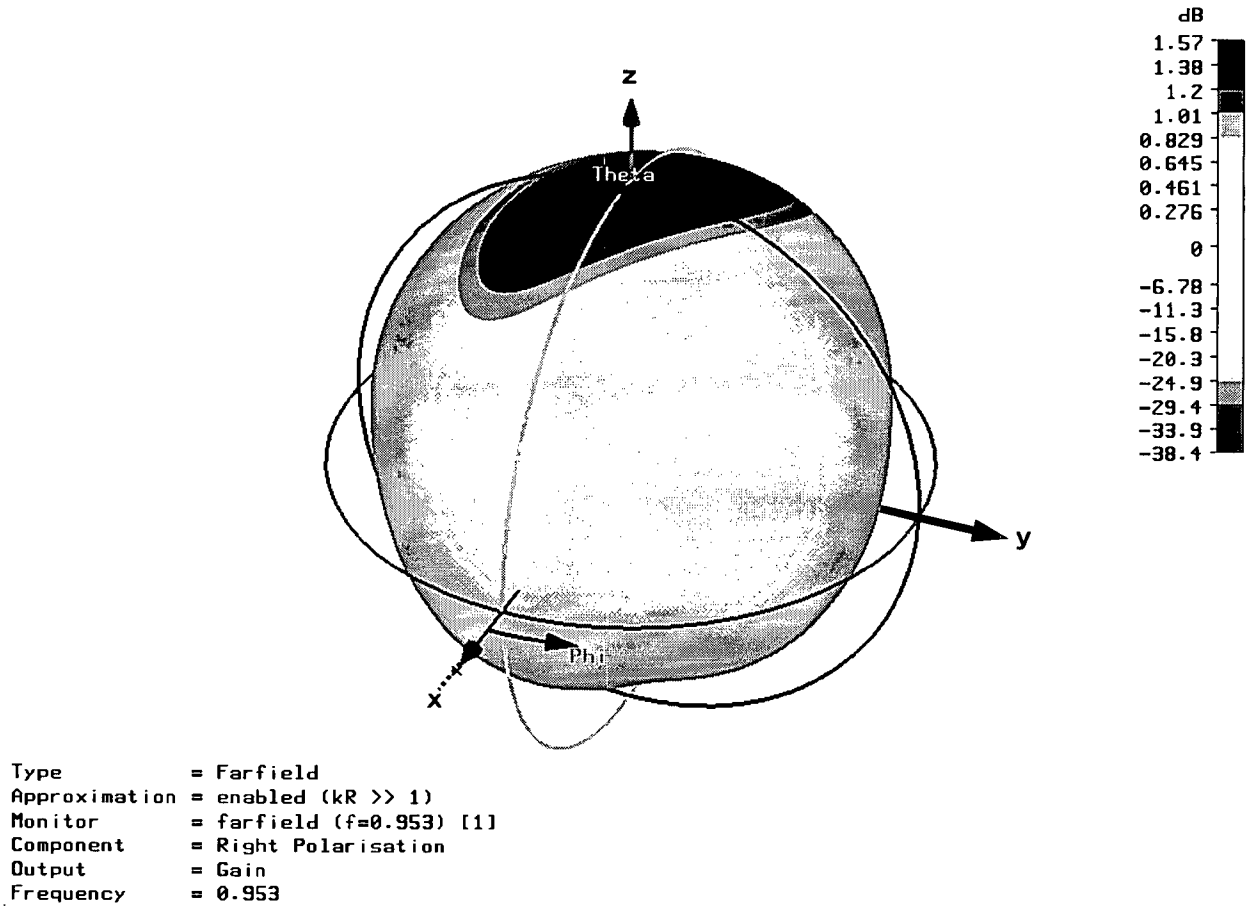
FIG. 4 is an example of a three-dimensional right-hand circular polarization gain radiation pattern of the planar antenna of FIG. 1.
Figure 5:
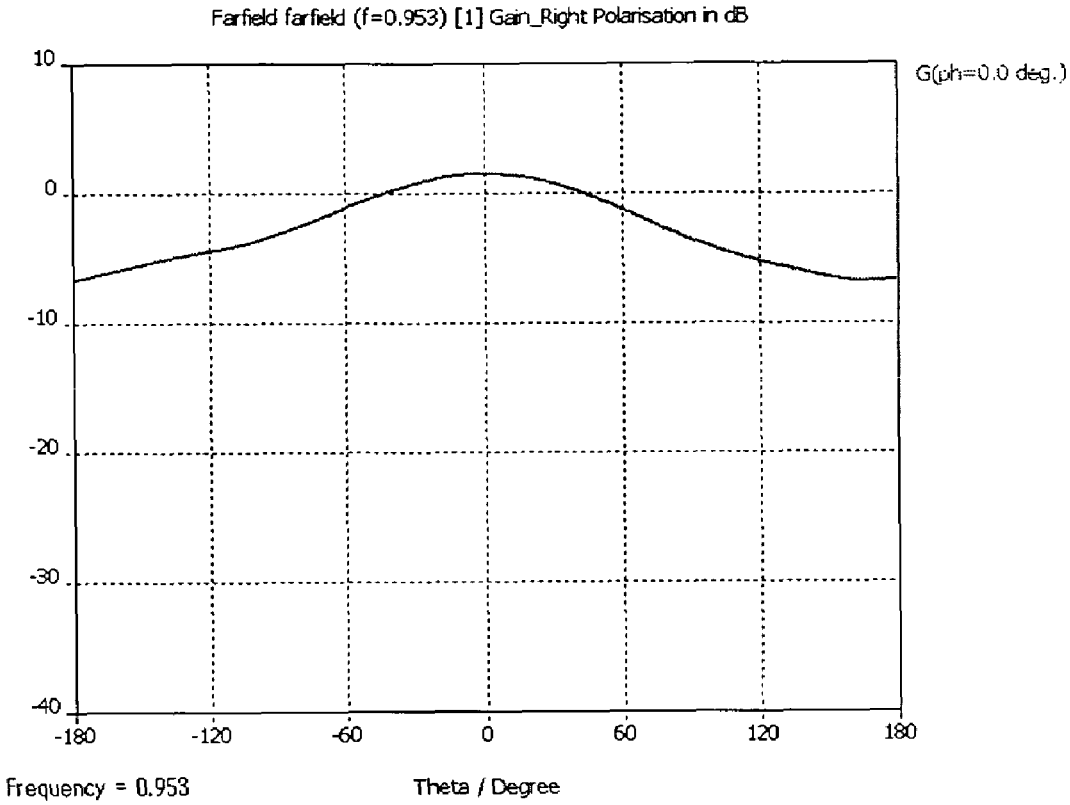
FIG. 5 is an example of a two-dimensional right-hand circular polarization gain radiation pattern of the planar antenna of FIG. 1.
Figure 6:
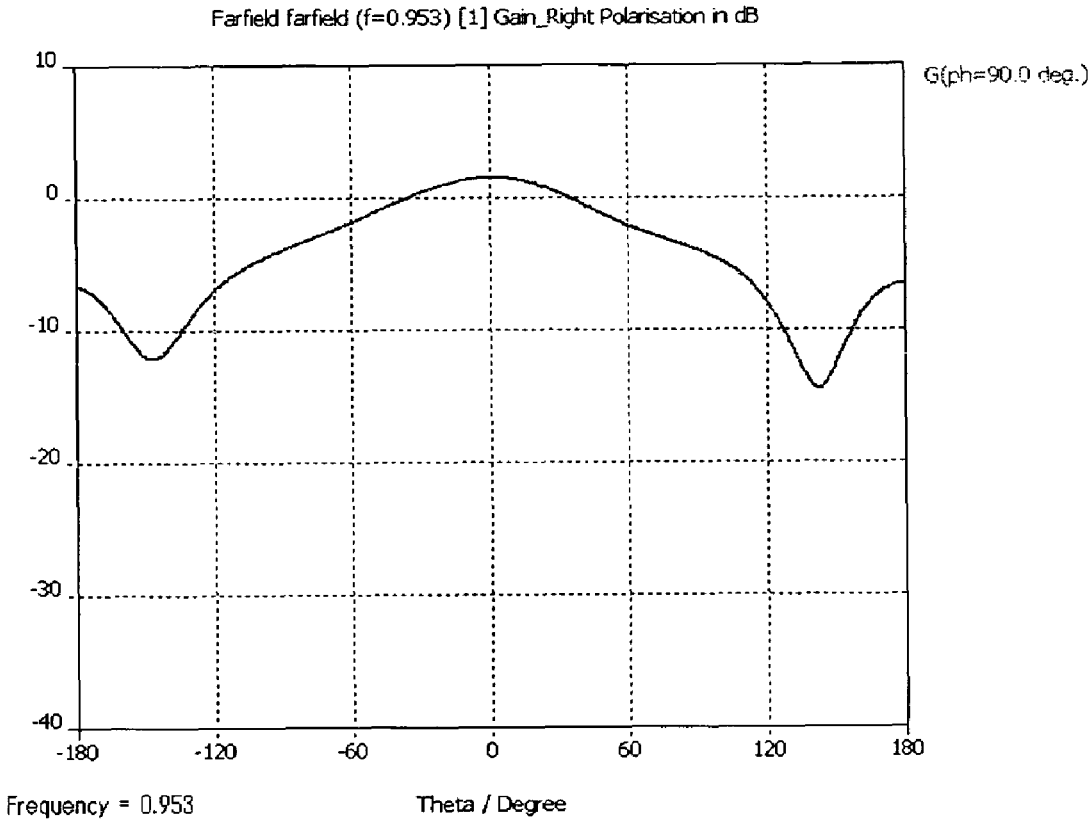
FIG. 6 is an example of a two-dimensional right-hand circular polarization gain radiation pattern of the planar antenna of FIG. 1.

FIG. 3 shows a three-dimensional power gain radiation pattern of the above planar antenna; FIG. 4 shows a three-dimensional right-hand circular polarization gain radiation pattern of the above planar antenna; FIG. 5 shows a two-dimensional (the x-z plane, that is, the plane along the power-supplied dipole antenna 1) right-hand circular polarization gain radiation pattern of the above planar antenna; FIG. 6 shows a two-dimensional (the y-z plane, that is, the plane orthogonal to the dipole antenna element 1) right-hand circular polarization gain radiation pattern of the planar antenna.

In this manner, in the planar antenna of the present embodiment, simple antenna elements 1, 2, and 3 (conductor patterns) formed on one surface of the dielectric substrate 10 are capable of producing circularly polarized waves with good characteristics on the opposite sides of the dielectric substrate 10.

Here, to produce a Left-Hand Circularly Polarized (LHCP) wave field, the loop antenna elements 2 and 3 should be placed at opposite sides relative to the dipole antenna element 1 (at symmetric positions opposite to those of FIG. 1).

(2) Second Embodiment

Figure 7:
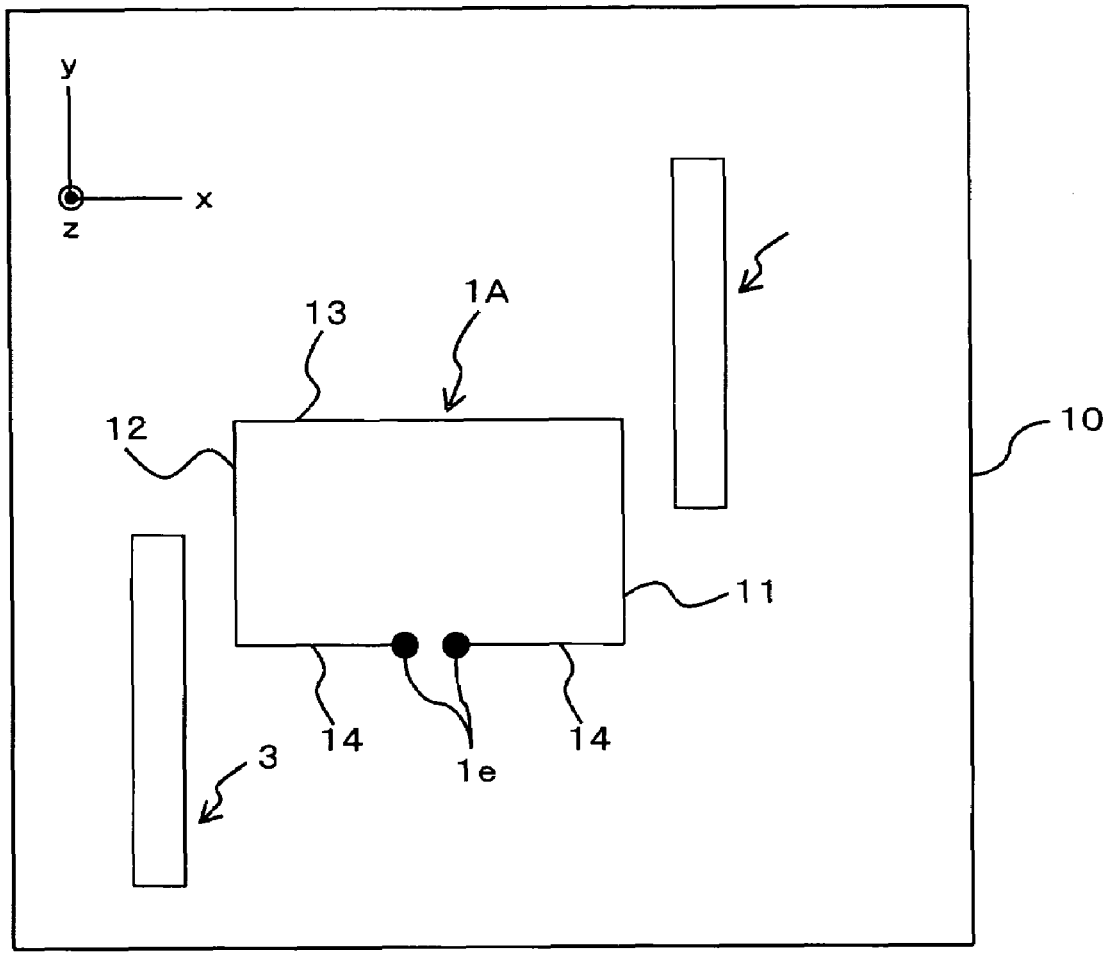
FIG. 7 is a schematic plan view showing a construction of a planar antenna according to a second embodiment of the present invention.

FIG. 7 is a schematic plan view showing a construction of a planar antenna according to a second embodiment of the present invention. In the planar antenna of FIG. 7, a four-sided (rectangular) loop antenna element (power-fed loop-shaped antenna element) 1A, which is supplied with electric power (power-fed) from a feeding point 1*e*, is formed on one surface (x-y plane) of a dielectric substrate 10, which is made of, for example, glass or ceramic. A parasitic rectangular loop antenna element (an antenna conductor serving as an electromagnetic coupling loop) 2 is placed in the vicinity of one side 11 of the two opposite (in the x-axis direction) sides (short sides) of the power-fed loop antenna element 1A, and the long sides of the loop antenna element 2 extend in the y-axis direction. In addition, another parasitic rectangular loop antenna element (an antenna conductor serving as an electromagnetic coupling loop) 3 is placed in the vicinity of the other side 12, and the long sides of the loop antenna element 3 extend in the y-axis direction.

In other words, the loop antenna elements 2 and 3 are placed outside the loop antenna element 1A in the vicinity of the loop antenna element 1A, and they are arranged symmetrically with respect to the center point of the loop antenna element 1A. With this arrangement, the loop antenna elements 2 and 3 can be electromagnetically coupled to the loop antenna element 1A via the sides 11 and 12.

Figure 8:
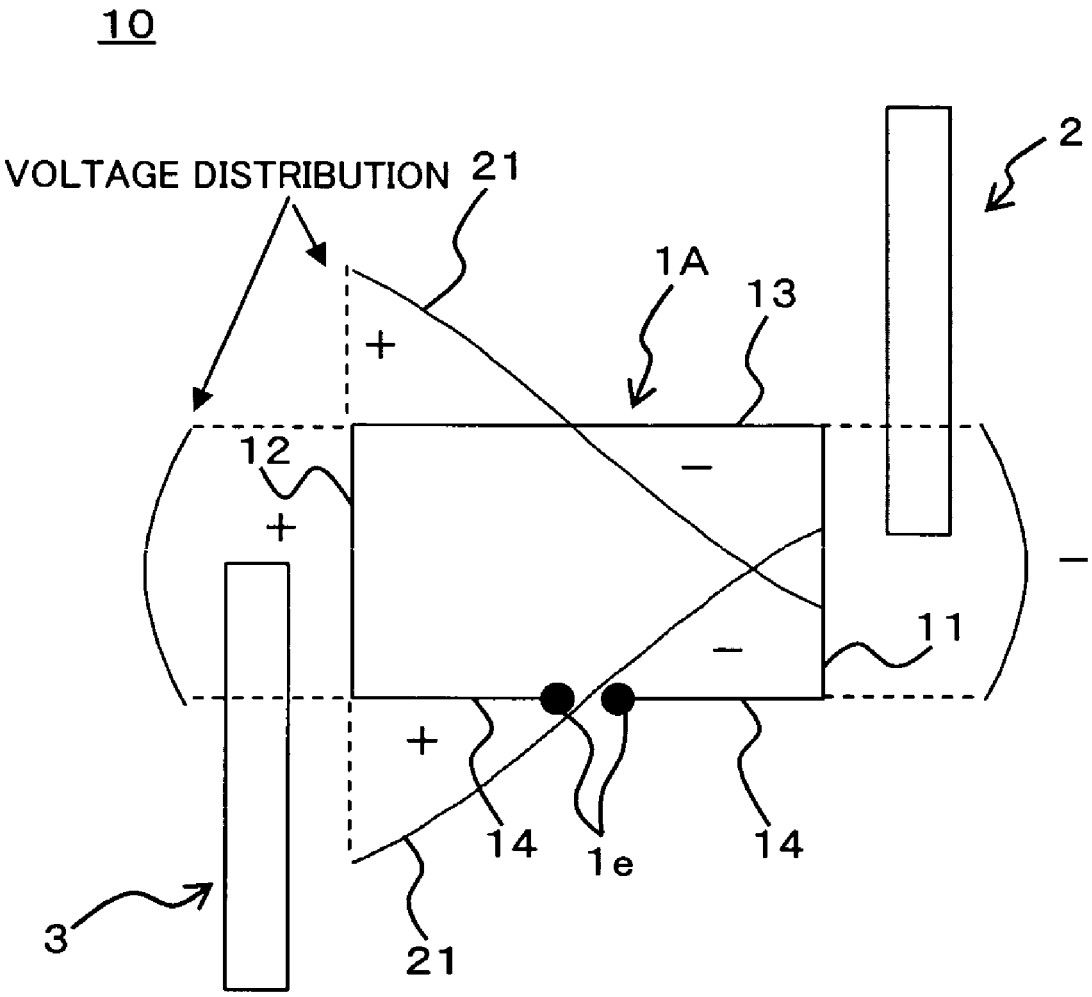
FIG. 8 is a schematic plan view showing the distribution of voltage when power is supplied to the planar antenna of FIG. 7 together with an antenna construction.

In this instance, in the present example, also, the positions at which the loop antenna elements 2 and 3 are placed are determined based on the voltage distribution formed by the loop antenna element 1A. More specifically, when the loop antenna element 1A is supplied with electric power, a voltage distribution shown in FIG. 8 with the reference character 21 is revealed. The voltage value (absolute value) on one long side 13 (the side opposite the feeding point 1*e*) of the loop antenna element 1A becomes greater at positions closer to the opposite ends of the long side 13, away from in the vicinity of the center of the long side 13. In addition, as shown by reference character 22, the voltage value (absolute value) on the other long side 14 (the side on which the feeding point 1*e* exists) of the loop antenna element 1A becomes greater at positions closer to the opposite ends of the long side 14, away from in the vicinity of the center of the long side 14. On the basis of this characteristic, it is preferable that the loop antenna elements 2 and 3 are placed in the vicinity of the sides 11 and 12 so that at least a portion (a portion of each long side) of the loop antenna elements 2 and 3 faces one of the line segments obtained by dividing the sides 11 and 12 into two equal parts.

If electric power is supplied to the loop antenna element 1A under such an antenna construction, an electric field ($E_x$ field) having a strong polarization (horizontal polarization) component in the x-axis direction is produced because the sides 13 and 14 are longer than the sides 11 and 12. The electric field is coupled to the loop antenna elements 2 and 3 via the sides 11 and 12, whereby electric current flows in the loop antenna elements 2 and 3.

In this case, also, since the long side of the loop antenna elements 2 and 3 extend in the y-axis direction, an electric field ($E_y$ field) which has a strong polarization component (vertical polarization) in the y-axis direction in comparison with in the x-axis direction is generated. As a result, in the z-axis direction (the vertical direction relative to the paper sheet of FIG. 7), an electric field resultant from composition of the above $E_x$ field and $E_y$ field, that is, a circularly polarized wave [in this case, right-hand circularly polarized (RHCP) wave] field is generated.

In other words, in the present example, also, the loop antenna elements 2 and 3, serving as a parasitic loop-shaped antenna element, are arranged so as to produce cross polarized waves (vertically polarized waves) which cross the main polarized waves (horizontally polarized waves) generated by the loop antenna element 1A. Further, each of the loop antenna elements 2 and 3 has a rectangular shape having linear portions (long sides) thereof extending in the direction which crosses the dipole antenna element 1, so as to produce vertically polarized waves.

Further, in the present example, also, it is possible to adjust the intensity and the phase of the cross electric field components which are orthogonal to each other by means of adjusting (i) the shape of the loop antenna elements 2 and 3 (the shape of the portion at which the loop antenna elements 2 and 3 are coupled to the loop antenna element 1A), (ii) the distance in the x-axis direction between the loop antenna element 1A and the loop antenna elements 2 and 3, and (iii) the positions of the loop antenna elements 2 and 3 in the y-axis direction. As a result, it is possible to obtain almost ideal circularly polarized waves.

In this manner, in the planar antenna of the present embodiment, simple antenna elements 1A, 2, and 3 (conductor patterns) formed on one surface of the dielectric substrate 10 are capable of producing circularly polarized waves with good characteristics on the opposite sides of the dielectric substrate 10. Accordingly, it is possible to efficiently receive circularly polarized waves in which the direction of the electric field changes over time, such as radio waves for GPS, satellite radio waves for satellite digital broadcasting, and radio waves for ETC, so that the reception characteristic of the circularly polarized waves is improved.

In this example, also, to produce a Left-Hand Circularly Polarized (LHCP) wave field, the loop antenna elements 2 and 3 should be placed at opposite sides relative to the center line of the long axis (x-axis) of the loop antenna element 1A (at symmetric positions opposite to those of FIG. 7).

(3) Third Embodiment

Figure 9:
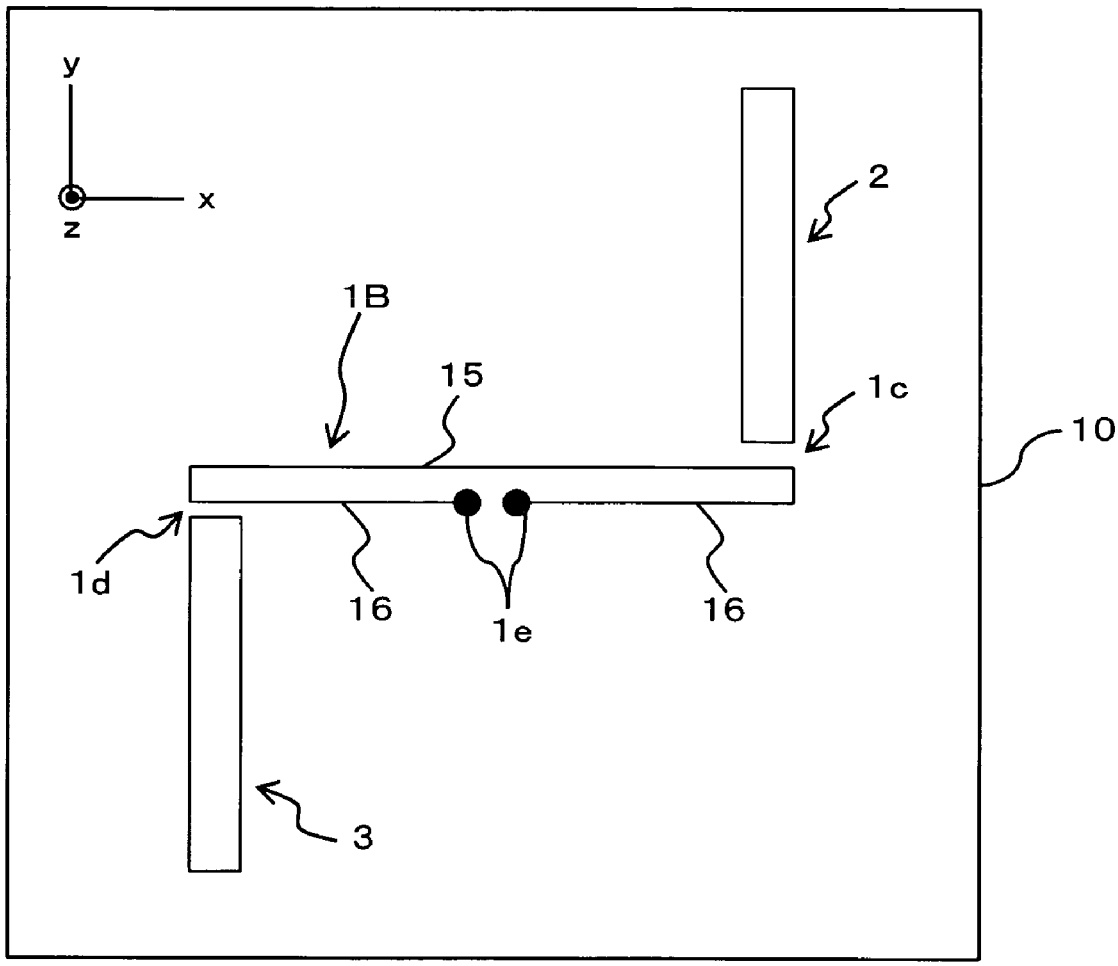
FIG. 9 is a schematic plan view showing a construction of a planar antenna according to a third embodiment of the present invention.

FIG. 9 is a schematic plan view showing a construction of a planar antenna according to a second embodiment of the present invention. In the planar antenna of FIG. 9, a folded dipole antenna element 1B, which is supplied with electric power (power-fed) from a feeding point 1*e*, is formed on one surface (x-y plane) of a dielectric substrate 10, which is made of, for example, glass or ceramic. A parasitic rectangular loop antenna element (an antenna conductor serving as an electromagnetic coupling loop) 2 is placed in the vicinity of one side 15 of the two opposite (in the y-axis direction) sides (long sides) 15 and 16 of the antenna element 1B, and the long sides of the loop antenna element 2 extend in the y-axis direction. In addition, another antenna element (an antenna conductor serving as an electromagnetic coupling loop) 3 is placed in the vicinity of the other side 16, and the long sides of the loop antenna element 3 extend in the y-axis direction.

That is, the planar antenna of FIG. 9 is equivalent to a construction of FIG. 1 in which the dipole antenna element 1 is replaced by the folded dipole antenna element 1B (hereinafter will be called the "antenna element 1B"). One loop antenna element 2 of the two loop antenna elements 2 and 3 is formed/placed in the vicinity of one end (folded part) 1*c* of the long side 15 of the antenna element 1B, and the other loop antenna element 3 is formed/placed in the vicinity of the other end (folded part) 1*d* of the long side 16 of the folded dipole antenna element 1B. The loop antenna elements 2 and 3 are formed/placed in the vicinity of the dipole antenna element 1 symmetrically with respect to the center point of the folded dipole antenna element 1B, so that the loop antenna elements 2 and 3 can be electromagnetically coupled to the antenna element 1B via the sides 15 and 16.

Figure 10:
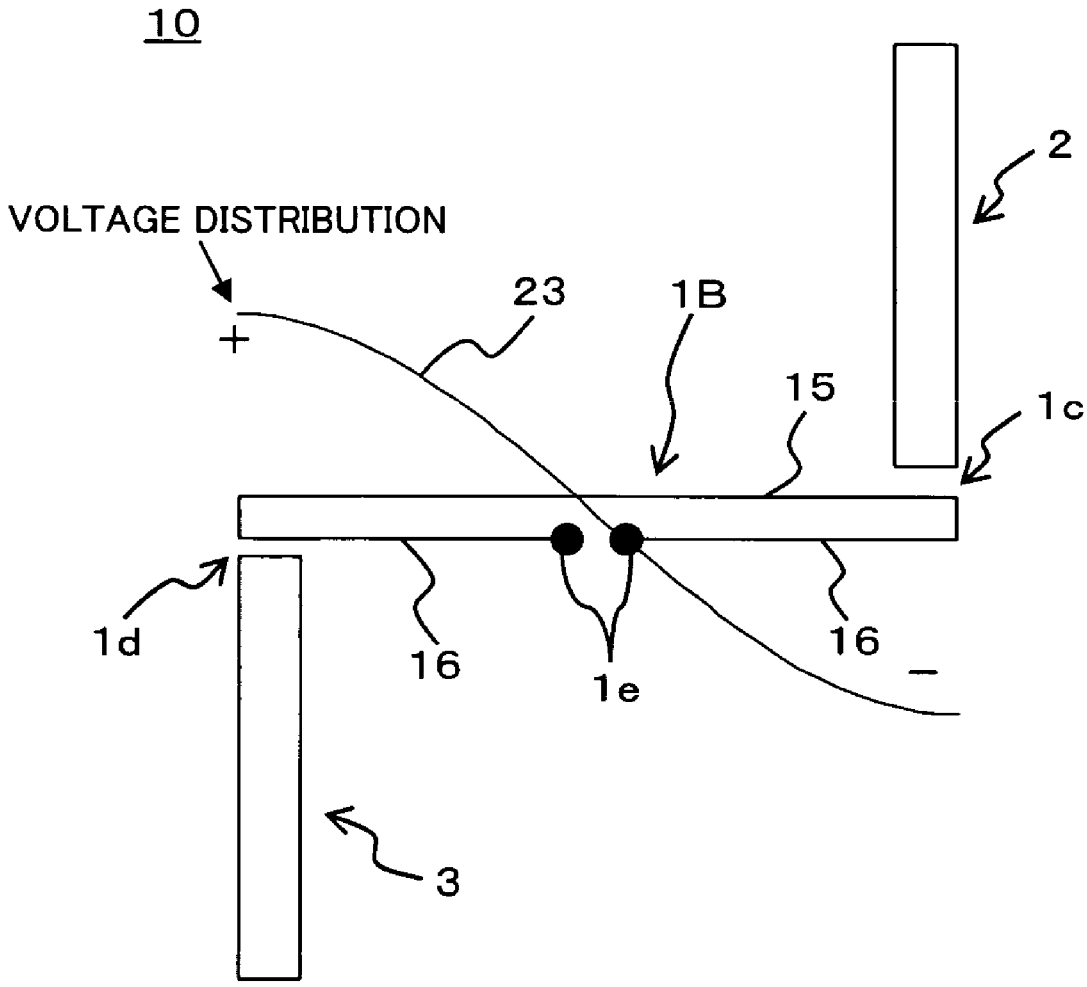
FIG. 10 is a schematic plan view showing the distribution of voltage when power is supplied to the planar antenna of FIG. 9, together with an antenna construction.
Figure 11:
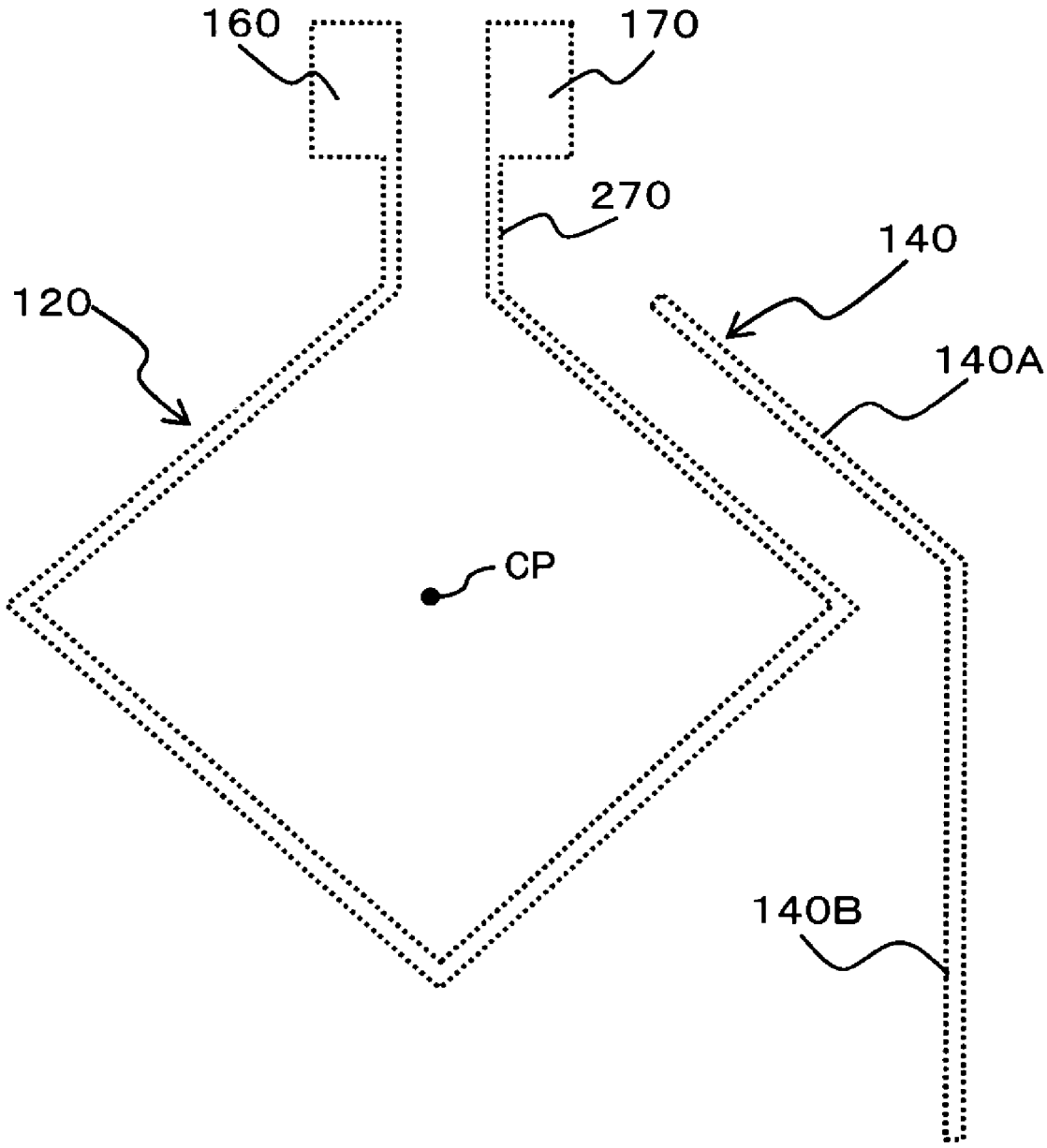
FIG. 11 is a schematic plan view showing a construction of a previous planar antenna.

Here, in the present example, also, the positions at which the loop antenna elements 2 and 3 are placed are determined based on the voltage distribution formed by the antenna element 1B. That is, when electric power is supplied to the folded dipole antenna element 1B, the voltage value (absolute value) becomes greater at positions closer to the opposite ends 1*c* and 1*d*, away from the center (in the proximity of the feeding point) of the antenna element 1B (the value takes the maximum value at opposite ends 1*c* and 1*d*), as shown in FIG. 10 with reference character 23. Thus, it is preferable that the loop antenna elements 2 and 3 are placed in the vicinity of the ends of the sides 15 and 16 where good coupling efficiency is revealed.

When electric power is supplied to the antenna element 1B under such an antenna construction, an electric field ($E_x$ field) having a strong polarization (horizontal polarization) component in the x-axis direction is produced by electric current flowing in the long sides 15 and 16, and the electric field is coupled to the loop antenna elements 2 and 3 via the sides 15 and 16, whereby electric current flows in the loop antenna elements 2 and 3.

In this case, also, since the long sides of the loop antenna elements 2 and 3 extend in the y-axis direction, an electric field ($E_y$ field) which has a strong polarization component (vertically polarized waves) in the y-axis direction in comparison with in the x-axis direction is generated. As a result, in the z-axis direction (the vertical direction relative to the paper sheet of FIG. 9), an electric field resultant from composition of the above $E_x$ field and $E_y$ field, that is, circularly polarized wave [in this case, right-hand circularly polarized (RHCP) wave] field is generated.

In other words, in the present example, also, the loop antenna elements 2 and 3, serving as a parasitic loop-shaped antenna element, are arranged so as to produce cross polarized waves (vertically polarized waves) which cross the polarized waves (horizontally polarized waves) generated by the folded dipole antenna element 1B. Further, each of the loop antenna elements 2 and 3 has a rectangular shape having linear portions (long sides) thereof extending in the direction which crosses the folded dipole antenna element 1B, so as to produce vertically polarized waves.

In this example, also, it is possible to adjust the intensity and the phase of the cross electric field components which are orthogonal to each other by means of adjusting (i) the shape of the loop antenna elements 2 and 3 (the shape of the portion at which the loop antenna elements 2 and 3 are coupled to the antenna element 1B), (ii) the distance in the x-axis direction between the antenna element 1B and the loop antenna elements 2 and 3, and (iii) the positions of the loop antenna elements 2 and 3 in the y-axis direction. As a result, it is possible to obtain almost ideal circularly polarized waves.

In this manner, in the planar antenna of the present embodiment, simple antenna elements 1B, 2, and 3 (conductor patterns) formed on one surface of the dielectric substrate 10 are capable of producing circularly polarized waves with good characteristics on the opposite sides of the dielectric substrate 10.

In this example, also, to produce a Left-Hand Circularly Polarized (LHCP) wave field, the loop antenna elements 2 and 3 should be placed at opposite sides relative to the center line of the long axis (x-axis) of the antenna element 1B (at symmetric positions opposite to those of FIG. 9).

(4) Other Modifications

The present invention should by no means be limited to the above-illustrated embodiment, and various changes or modifications may be suggested without departing from the gist of the invention.

That is, in the planar antenna of the present invention, it is satisfactory if the parasitic loop-shaped antenna element is placed so as to produce cross polarized waves which cross the polarized waves (main polarized waves) generated by a power-fed linear antenna element or a power-fed loop-shaped antenna element (hereinafter will be called the "power-fed element"). Further, the parasitic loop-shaped antenna elements can have any shape as long as they have linear portions which extend in the direction crossing the power-fed element.

For example, although the loop antenna elements 2 and 3 have a rectangular shape (four-sided shape) in the above-described examples, they can have the shapes of triangle, circle, or other polygons.

As described so far, by using the planar antenna of the present invention, it is possible to efficiently receive circularly polarized waves in which the direction of the electric field changes over time, such as radio waves for GPS, satellite radio waves for satellite digital broadcasting, radio waves for ETC, and radio waves from RF-ID tags in POS systems and security systems. In this manner, the present invention is considerably useful in technologies in which radio waves are utilized.

What is claimed is:

1. A planar antenna, comprising:

on one side of a dielectric substrate, a linear antenna element to which electric power is to be supplied; and two loop-shaped-parasitic antenna elements, where each of said loop-shaped-parasitic antenna element has a rectangular shape having a long side which is a linear portion extending in a direction which crosses said linear antenna element, placed in the vicinity of said linear antenna element so as to produce cross polarized waves which cross polarized waves produced by said linear antenna element.

2. A planar antenna as set forth in claim 1, wherein said two looped-shaped parasitic antenna elements are placed symmetrically with respect to a center point of said linear antenna element.

3. A planar antenna as set forth in claim 2, wherein said two loop-shaped parasitic antenna elements are provided in the vicinity of the opposite ends of said linear antenna element.

4. A planar antenna as set forth in claim 3, wherein each of said loop-shaped parasitic antenna elements has the rectangular shape in the plane of the dielectric substrate.

5. A planar antenna as set forth in claim 2, wherein each of said loop-shaped parasitic antenna elements has the rectangular shape in the plane of the dielectric substrate.

6. A planar antenna as set forth in claim 1, wherein each of said loop-shaped parasitic antenna elements has the rectangular shape in the plane of the dielectric substrate.

7. A planer antenna as set forth in claim 1, wherein said linear antenna element is a dipole antenna.

* * * * *